US005346000A

United States Patent [19]

Schlitt

[11] Patent Number: 5,346,000

[45] Date of Patent: Sep. 13, 1994

[54] HEAT PIPE WITH A BUBBLE TRAP

[75] Inventor: Reinhard Schlitt, Bremen, Fed. Rep. of Germany

[73] Assignee: ERNO Raumfahrttechnik GmbH, Bremen, Fed. Rep. of Germany

[21] Appl. No.: 158,411

[22] Filed: Nov. 29, 1993

[30] Foreign Application Priority Data

Nov. 28, 1992 [DE] Fed. Rep. of Germany ..... 4240082

[51] Int. Cl.[5] ..... F28D 15/02

[52] U.S. Cl. ..... 165/104.26; 122/366

[58] Field of Search ..... 165/104.26; 122/366

[56] References Cited

U.S. PATENT DOCUMENTS 3,844,342 10/1974 Eninger et al. ..... 165/104.26
4,515,207 5/1985 Alario et al. ..... 165/104.26
5,027,597 7/1991 Soeffker et al. .
5,209,288 5/1993 Brown et al. ..... 165/104.26

OTHER PUBLICATIONS

Heat Pipe Design Handbook vol. 1, pp. 147–153 B&K Engineering Inc.

*Primary Examiner*—Albert W. Davis, Jr.
*Attorney, Agent, or Firm*—W. G. Fasse; W. F. Fasse

[57] ABSTRACT

A heat pipe is equipped with a bubble trap. Such bubble trap takes the form of a baffle that restricts the liquid flow in the liquid flow channel of the heat pipe to divide the two-phase flow in the liquid channel into a liquid flow and into a bubble and liquid flow. A cage of wire mesh is positioned downstream of the baffle to entrap the bubbles. In another embodiment the bubble trapping cage is a chamber that extends all the way into the evaporating end of the pipe while the baffle is arranged upstream of such a chamber which is additionally connected through perforations to the liquid flow channels.

12 Claims, 2 Drawing Sheets

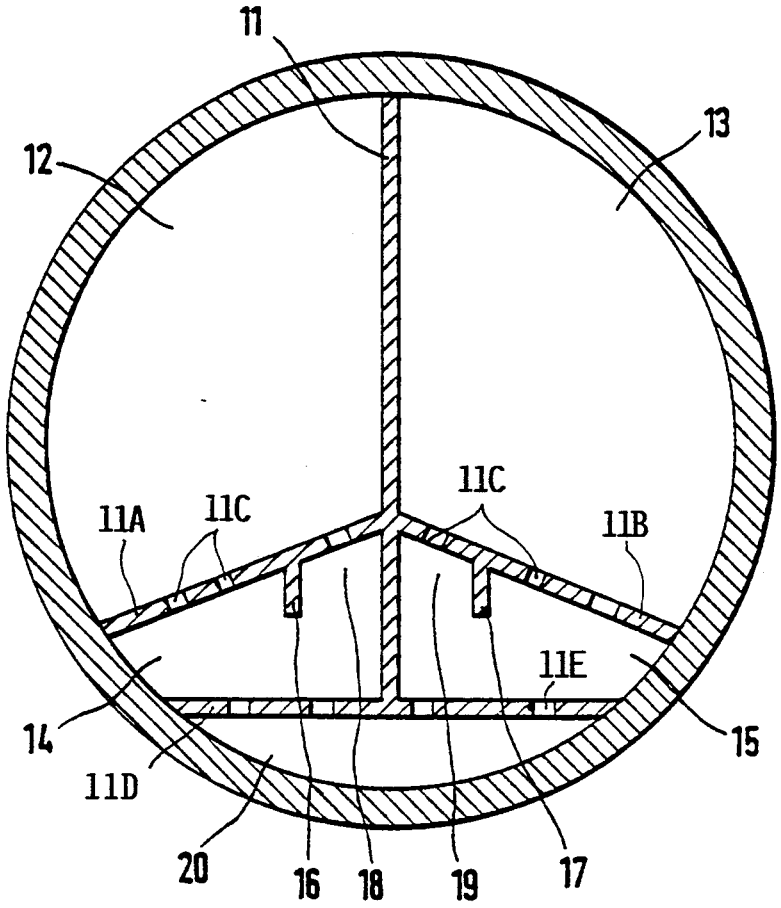
Fig. 2
Fig. 3
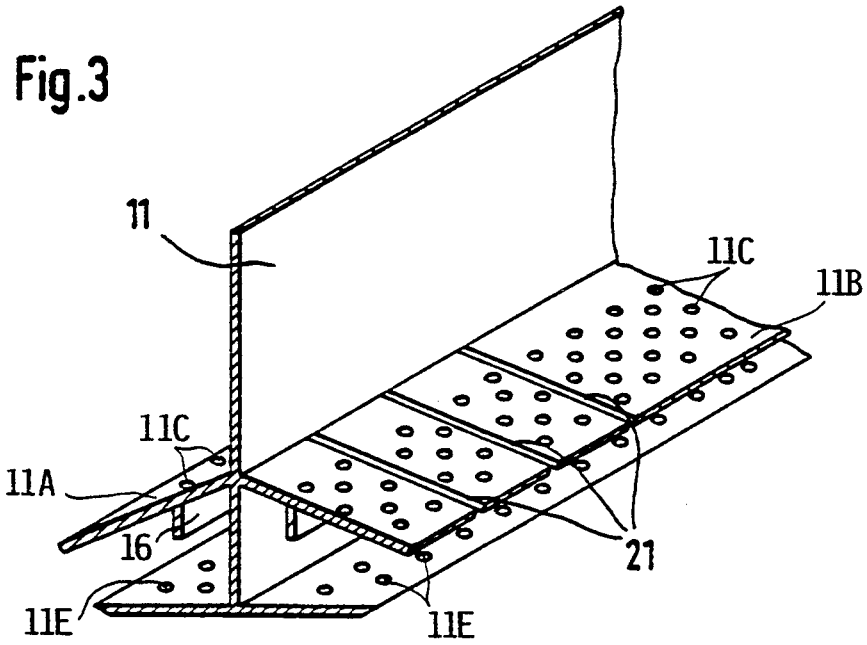

HEAT PIPE WITH A BUBBLE TRAP

CROSS-REFERENCE TO RELATED APPLICATION

This application relates to application Document No.: 2944 for: "HEAT PIPE, WITH A COOLED BUBBLE TRAP", filed simultaneously with the present application.

FIELD OF THE INVENTION

The invention relates to a heat pipe which is particularly suitable for removing heat from a spacecraft.

BACKGROUND INFORMATION

Heat pipes comprise at least one heat conveying pipe filled with a heat carrier, also referred to as medium. At least one flow channel for the liquid phase of the medium and one flow channel for the vapor phase of the medium are provided in the heat conveying pipe. Heat pipes are also equipped with features for removing bubbles from the liquid flow channel. Furthermore, at least one radiator or heat exchanger is connected to the heat pipe in a heat exchanging contact.

As mentioned, heat pipes for the transport of heat are known, especially from their use in space technology. These heat pipes operate by evaporating the medium at a heat receiving end of the heat pipe and then transporting the vapor to a heat discharging end of the heat pipe where the vapor is condensed again and returned to the evaporating end of the pipe. The medium is conventionally ammonia. As the vapor condenses at the heat discharging end of the pipe, the latent heat stored in the vapor is discharged to the surrounding of the spacecraft while the condensate being formed flows back to the heat receiving evaporating end of the pipe. The transport of the vapor from the evaporating end to the condensing end is a normal compression flow while the flow of the liquid from the condensing end to the evaporating end is a capillary flow. Different radii of curvature along the boundary surface between the liquid and the vapor at the evaporating end of the pipe on the one hand, and at the condensating end of the pipe on the other hand, and the capillary forces caused by these different radii, result in a pressure difference in the direction from the condensating end of the pipe toward the evaporating end of the pipe and this pressure difference maintains the required flow. The resulting flow velocity is established by the equilibrium between the pressure loss due to friction forces and the effective pressure difference of the capillary forces.

Modern high performance heat pipes are capable of transporting heat quantities within the range of about 1 kw over distances between 1 and about 10 m, even at relatively low temperature differences between the evaporating and condensating ends of the pipe.

Comparing these high performance heat pipes with other conventional heat pipes, the higher power of the high performance heat pipes is achieved, due to the fact that the transport of the liquid takes place in channels having differing dimensions. On the one hand, in the evaporating area of the pipe, a plurality of very small channels are provided which extend in the circumferential direction and which have capillary geometries in order to achieve large capillary driving forces. On the other hand, the guidance of the flow in the condenser area and return flow path of the pipe there are only a few flow channels or even a single flow channel having a relatively large diameter. These few channels or the single channel are also referred to as "artery channels". In this manner friction caused pressure losses are minimized and a substantially larger fluid mass flow is achieved with the same capillary forces as are present in normal heat pipes. As a result of the substantially larger fluid mass flow, a substantially higher heat flow is also achieved.

However, a substantial problem is encountered in the operation of such high performance heat pipes in that the function of these high performance heat pipes is substantially adversely affected or may even be totally interrupted when bubbles are formed of the medium vapor or of gaseous non-condensable contaminations in the artery channels. These contaminations could have been present in the heat pipe already at the time of putting the heat pipe into service or these contaminations could have been generated, for example, by an operational overloading of the heat pipe, such as could occur by an overheating of the evaporator end when a short duration complete drying of the evaporator end of the heat pipe should occur. These bubbles can even interrupt the transport of the heat carrier fluid to the heat take-up or evaporator zone so that the heat take-up zone even dries further and thus the heat pipe becomes inoperative, in other words, ceases to function properly.

In a publication "Heat Pipe Design Handbook", Volume 1, by E & K Engineering, Inc., Towsen, Md., 21204, pages 147 to 153, and especially pages 149 and 152, two heat pipes are described with features for removing bubbles, and thus for avoiding blockage of the fluid flow by these gas bubbles. In one of the conventional heat pipes, the gas bubbles are removed by the arrangement of venting bores in the boundary wall between the artery and the vapor flow channel. In the other conventional construction the bubble removing feature includes a Venturi nozzle which is arranged in the transport channel for the vapor and which simultaneously functions as a jet pump for sucking off any gas bubbles that may be present in the artery.

A disadvantage of having venting bores in the boundary wall between the artery and the vapor channel, is seen in the fact that during the operation of the heat pipe, the pressure in the vapor channel is substantially higher than in the artery. As a result, it is necessary to interrupt the operation of the heat pipe for transferring gas bubbles from the artery into the vapor channel. However, during such interruption of the operation, the venting bores are covered by liquid bridges which block the passage of gas bubbles through these venting bores unless these liquid bridges are first evaporated. As a result, these interruptions of the operation of the heat pipe require a relatively long time duration for the gas bubble removal before the heat pipe can be returned to its normal operation.

The arrangement of a Venturi nozzle in the vapor channel has the following disadvantage. If there happens to be no gas bubble in the suction zone of the nozzle, a small quantity of heat carrier medium tends to collect in the suction pipe of the nozzle and this medium is taken out of the artery. If now a gas bubble appears in fact in front of the suction opening of the Venturi nozzle, it is necessary to first remove the liquid accumulated in the suction pipe before the bubble can be sucked out of the artery. As a result of this procedure, there is a substantial pressure loss in the flow through the suction pipe which correspondingly results in a substantial pressure loss in the Venturi pipe. Stated differently, this Venturi pipe must be constructed to have a relatively substantial reduction in its flow cross-sectional area. This requirement in turn leads to a substantial impairment of the vapor flow due to the pressure loss, whereby the working capacity of the heat pipe is respectively reduced.

OBJECTS OF THE INVENTION

In view of the foregoing it is the aim of the invention to achieve the following objects singly or in combination:

to construct a heat pipe, especially for use in a spacecraft in such a way that vapor bubbles of the heat carrier medium as well as bubbles formed by a non-condensible gas are simply, rapidly, efficiently and reliably removed from the respective fluid flow channel while the heat pipe remains in operation;

the removal of any kind of gas bubbles from the fluid flow channel shall be possible without interrupting the operation of the heat pipe and even if such bubbles occupy the larger proportion of the flow cross-sectional area in the respective flow channel;

the removal of such bubbles must also be efficiently accomplished substantially without impairing the efficacy of the heat pipe;

to assure an automatic gas and vapor bubble removal by suction applied to the heat pipe portion where these bubbles are collected; and to use a plurality of bubble traps arranged in the same heat pipe in sequence.

SUMMARY OF THE INVENTION

The above objects have been achieved according to the invention in a heat pipe having at least one liquid flow channel and at least one vapor flow channel for transporting vapor from a heat absorbing vaporizing end of the heat pipe to a heat discharging condenser end of the heat pipe and for transporting liquid from the condenser end to the evaporator end, wherein according to the invention at least one, preferably several bubble traps are provided in the liquid transport channel, whereby the liquid bubble trap comprises a baffle that extends at least into a portion of the cross-sectional flow area of the liquid flow channel and wherein at least one bubble trapping cage is arranged downstream of the baffle. Preferably the cage is made of mesh material so dimensioned that liquid passes through the trapping cage while gas and vapor bubbles are entrapped in the cage.

Further features of the invention described below make sure that the maximal heat transport efficiency of the heat pipe is substantially not adversely influenced by the bubble entrapping features of the invention. These features simultaneously assure a highly safe operation, thereby avoiding shut-downs of the heat pipe while simultaneously making the heat pipe tolerant to faults in the cooling system.

The invention makes use of the characteristic of a two-phase flow which contains liquid as well as gas bubbles. This characteristic is known from German Patent Publication DE 3,826,919, which corresponds to U.S. Pat. No. 5,027,597 (Soeffker), published on Jul. 2, 1991, and disclosing an apparatus for storing propellant in a satellite. If a fluid flow is divided in two partial flows of which one flow retains its original flow direction, while the other flow is diverted, then gas bubbles continue to travel with the diverted partial flow while the partial flow that continues in the original direction is free of bubbles. As a result, in the heat pipe according to the invention, a completely automatic removal of gas or vapor bubbles is achieved by suction without requiring a shut-down of the heat pipe. An added advantage of the invention is seen in that any reduction in the efficiency of the heat pipe due to the arrangement of one or several such bubble traps in the artery or liquid flow channel is minimal and substantially smaller than in conventional heat pipes.

BRIEF DESCRIPTION OF THE DRAWINGS

In order that the invention may be clearly understood, it will now be described, by way of example, with reference to the accompanying drawings, wherein:

FIG. 2 shows a cross-sectional view through another embodiment of a heat pipe according to the invention with a partition; and FIG. 3 shows a perspective view of the partition as used in the embodiment of FIG. 2.

Figure 1:
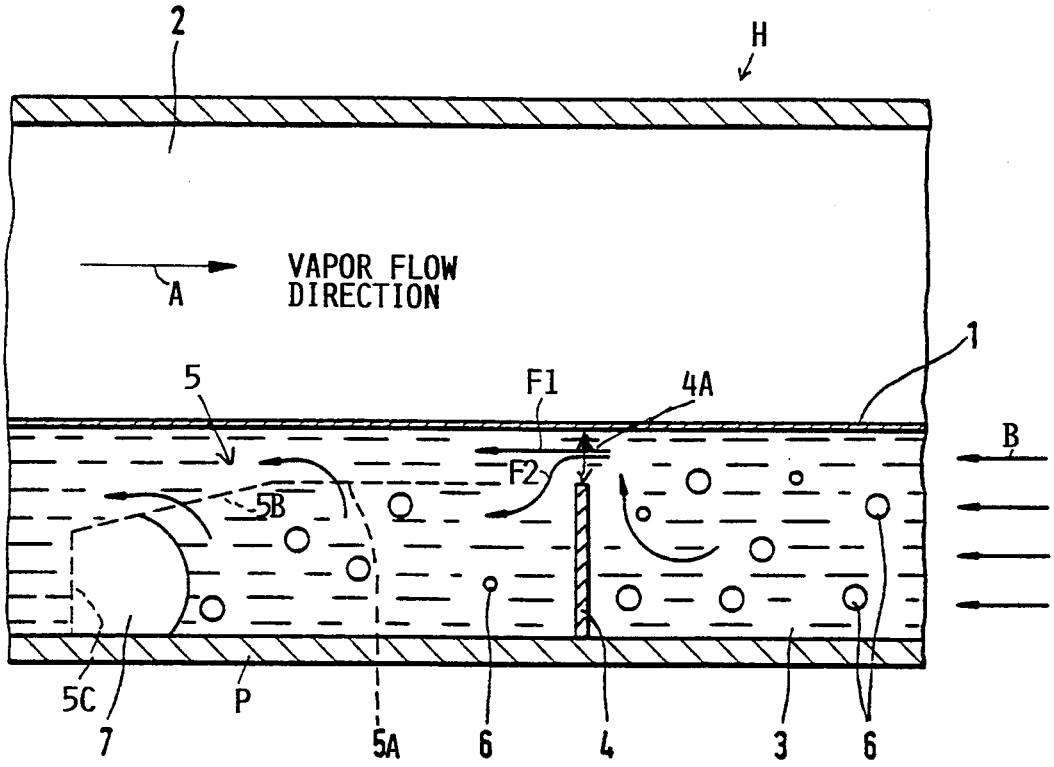
FIG. 1 shows an axial longitudinal section through a portion of a heat pipe according to the invention equipped with a baffle and a bubble trap cage forming together a bubble trapping device.

DETAILED DESCRIPTION OF PREFERRED EXAMPLE EMBODIMENTS AND OF THE BEST MODE OF THE INVENTION

FIG. 1 shows a sectional view through a portion of a heat pipe according to the invention, the portion being taken between an evaporating end and a condenser end of the heat pipe. The ends are not shown. However, the evaporator end would be located left in FIG. 1, from the viewer's position, and the condenser end would be located to the right so that vapor flows from left to right as shown by the arrow A and condensed liquid flows from right to left as shown by the arrows B. The heat pipe H comprises a pipe P divided by a partition 1 into a vapor flow channel 2 and a liquid flow channel 3. The partition 1 is so positioned that the cross-section flow area of the vapor flow channel 2 is larger than the cross-sectional flow area of the liquid flow channel 3.

According to the invention a baffle member 4 is arranged in the liquid flow channel 3, also referred to as the artery. The baffle member 4 covers a portion of the cross-sectional flow area of the liquid flow channel 3 leaving a restricted throughflow area 4A between the partition 1 and the top edge of the baffle member 4. The effect of the baffle member 4 is to divide the liquid flow into two portions F1 and F2, as will be described in more detail below. Bubbles are collected in F2.

Downstream, as viewed in the flow direction B, of the baffle member 4, there is arranged a bubble trap element 5 made of, for example, a wire mesh webbing having such a mesh size that liquid can pass through the open mesh areas while bubbles 6 or 7 are entrapped. The baffle member 4 is also preferably made of a wire mesh webbing arranged in a plurality of layers.

The flow F1 continues in the flow direction B while the flow F2 is diverted downwardly. The flow F1 comprises substantially liquid while the flow F2 comprises liquid and bubbles. The bubbles may be gas bubbles or vapor bubbles 6. It is believed that this phenomenon that separates the bubbles from the flow F1 is due to the fact that the liquid component of the two-phase flow has the larger inertia and hence a stronger tendency to retain its original flow direction while the substantially lighter bubbles 6 tend to be entrained in the diverted flow F2 due to their smaller inertia.

As mentioned, the mesh size of the bubble entrapping element 5, for example, formed as a cage, is so selected that liquid passes through while bubbles are held due to the higher surface tension at the interface between the liquid and the bubbles. A plurality of bubble trap cages and baffles can be arranged along the length of the heat pipe. A baffle 4 would always be arranged between two neighboring cages 5. The illustration of such an arrangement would merely show two sections as shown in FIG. 1 arranged next to each other. It is advantageous to arrange at least one such bubble trap with a baffle 4 and a cage 5 at the entrance end of each section of the heat pipe, for example, when the heat pipe is assembled of a plurality of pipe sections. A bubble trap positioned at the entrance of the evaporator end of the pipe is also very effective and hence advantageous.

According to the invention, a complete trap includes the baffle 4 and the cage 5 with the baffle always arranged upstream of the cage as viewed in the liquid flow direction B. By properly dimensioning the spacing 4A to provide a sufficient liquid cross-sectional flow area, the main liquid flow between the condenser end and the evaporator end of the heat pipe is maintained. The small bubbles 6 can accumulate to form a larger bubble 7 at the lower or downstream end of the cage 5. However, the cage 5 is so configured that the accumulation of large bubbles 7 takes place near the bottom surface of the pipe P as seen in FIG. 1. For this purpose, the cage 5 has an upstream section 5A extending substantially in parallel to the liquid flow F1, an intermediate section 5B extending at a downward slant toward a downstream section 5C extending, for example, perpendicularly to the flow direction F1. This tapering shape of the cage 5 limits the size of the bubbles 7 in the downstream end of the cage 5. As a result, this tapering shape of the cage 5 prevents the accumulation of bubbles to such an extent that the whole cross-sectional area would be blocked. Hence, an efficient liquid flow in the liquid flow channel is maintained.

In the embodiment of FIGS. 2 and 3, the trapping cage is formed as a bubble trapping chamber 20 which is integrated into the internal structure of the heat pipe P1. The interior cross-sectional area of the heat pipe P1 is divided by a partition 11 having a central section extending longitudinally and axially through the heat pipe as well as two side sections 11A and 11B provided with perforations 11C and slanting away from the central section. The partition forms two vapor flow channels 12 and 13 bounded by the central partition section 11 and two liquid flow channels 14 and 15. A lower end section 11D provided with perforations 11E extends preferably perpendicularly relative to the lower end of the central section to form the bubble trap chamber 20 that extends substantially in parallel to the liquid flow channels 14 and 15.

Two longitudinal lands 16 and 17 facing downwardly from the slanting partition sections 11A and 11B further divide the liquid flow channels 14 and 15 respectively to form channel zones 18 and 19 functioning as so-called auxiliary arteries to enhance the liquid flow of condensate from the condenser end to the evaporator end of the heat pipe P1.

The trapping chamber 20 extends substantially over the entire transport or flow area along the liquid flow channels 14 and 15 and all the way into the evaporator zone. At least one baffle as shown in FIG. 1 at 4 is also arranged upstream of the trap chamber 20, whereby bubbles are guided into the trap chamber 20 and then flow all the way to the evaporating end of the pipe while further bubbles are passing through the perforations 11E in the end section 11D that separates the liquid flow channels 14, 15 from the trap chamber 20.

The perspective view of FIG. 3 shows the partition 11 and the further feature that the slanting partition sections 11A and 11B are provided with narrow slots 21 which interconnect circumferential grooves in the inwardly facing surface of the heat pipe P1. Such grooves are not shown in FIGS. 2 and 3. However, one such groove could be represented by a further circle, at least in the chambers 12 and 13. Additionally, the narrow slots 21 can also permit the passage of bubbles from the vapor flow channels directly into the liquid flow channels as is possible through the perforations 11C. Further collection of bubbles then takes place into the chamber 20 as described. As a result, the flow channels 12 and 13 for the vapor and 14 and 15 for the liquid are substantially free of bubbles for all practical purposes.

Preferably, the partition 11 with its sections is formed as an extruded component of metal or the like.

Although the invention has been described with reference to specific example embodiments, it will be appreciated that it is intended to cover all modifications and equivalents within the scope of the appended claims.

What I claim is:

1. A heat pipe structure comprising a heat pipe having at least one liquid flow channel for liquid evaporant and at least one vapor flow channel for vaporized evaporant, said liquid flow channel having a liquid flow cross-section, a bubble trap arranged for collecting gas and/or vapor bubbles from said liquid flow channel of said heat pipe, said bubble trap comprising at least one baffle member (4) positioned in at least one location in said liquid flow channel, said baffle member (4) blocking a portion of said liquid flow cross-section, and at least one bubble trapping element arranged in said liquid flow channel downstream of said baffle member as viewed in the flow direction, said bubble trapping element being permeable to liquid and impermeable to gas bubbles, said baffle member (4) guiding bubbles into said bubble trapping element.

2. The heat pipe structure of claim 1, wherein said bubble trapping element (5) comprises at least one cage made of a wire mesh webbing.

3. The heat pipe structure of claim 2, comprising a plurality of said cages arranged in sequence in said liquid flow channel with a spacing between neighboring cages, and wherein one of said baffle members is positioned in each spacing between neighboring cages.

4. The heat pipe structure of claim 1, wherein said bubble trapping element comprises a perforated sheet metal member (11D) inserted between a bubble trap chamber (20) and said at least one liquid flow channel (14), said sheet metal member (11D) having perforations (11E) therein communicating said bubble trap (20) with said at least one liquid flow channel of said heat pipe.

5. The heat pipe structure of claim 1, wherein said baffle member (4) comprises at least one layer of a wire mesh webbing.

6. The heat pipe structure of claim 1, further comprising a partition (11) extending longitudinally axially in said heat pipe, said partition (11) dividing said heat pipe into two vapor flow channels (12, 13), into two liquid flow channels (14, 15), and into a bubble trapping chamber (20).

7. The heat pipe structure of claim 6, wherein said partition (11) comprises a central element, two side elements (11A, 11B), and an end element (11D), said central element and said two side elements bounding said two vapor flow channels (12, 13), said end element (11D) and said two side elements bounding said two liquid flow channels (14, 15), said end element (11D) bounding a bubble trapping chamber (20) inside said heat pipe.

8. The heat pipe structure of claim 7, wherein said partition (11) is an extruded component.

9. The heat pipe structure of claim 7, wherein said end element (11D) has perforations (11E) therein for communicating said bubble trapping chamber in the form of a channel (20) with said liquid flow channels (14, 15), and wherein said side elements (11A, 11B) also have perforations (11C) therein for communicating said vapor flow channels with said liquid flow channels.

10. The heat pipe structure of claim 7, wherein said two side elements (11A, 11B) have crosswise slots (21) therein.

11. The heat pipe structure of claim 1, wherein said bubble trapping element (5) comprises a wire mesh cage having a first upstream cage section (5A) extending substantially in parallel to said liquid flow direction, an intermediate cage section (5B) slanting toward a pipe wall, and a downstream cage section (5C) extending substantially rectangularly to said liquid flow direction for limiting any liquid flow blockage by entrapped bubbles.

12. The heat pipe structure of claim 11, wherein said wire mesh has such a mesh size that liquid can flow through the wire mesh while bubbles are prevented from passing through the mesh size.

* * * * *